US005830110A

United States Patent [19]

Fielding

[11] Patent Number: 5,830,110

[45] Date of Patent: Nov. 3, 1998

[54] SPRING-ACTUATED, PORTABLE WEIGHT TRAINING DEVICE

[76] Inventor: Rory F. Fielding, 769 Coventry St., Boca Raton, Fla. 33487

[21] Appl. No.: 901,839

[22] Filed: Jul. 28, 1997

[51] Int. Cl.[6] ..... A63B 21/02

[52] U.S. Cl. ..... 482/44; 482/121; 482/122; 482/126

[58] Field of Search ..... 482/44, 121, 122, 482/126, 128

[56] References Cited

U.S. PATENT DOCUMENTS

| | | | |
|---|---|---|---|
| 4,273,328 | 6/1981 | Ozbey et al. . | |
| 4,290,599 | 9/1981 | Berger . | |
| 4,376,533 | 3/1983 | Kolbel . | |
| 4,428,577 | 1/1984 | Weingardt . | |
| 4,695,049 | 9/1987 | Ciemiega | 482/128 |
| 4,815,731 | 3/1989 | Suarez et al. . | |
| 4,869,491 | 9/1989 | Nolan | 482/128 |
| 5,031,906 | 7/1991 | Jang . | |
| 5,186,701 | 2/1993 | Wilkinson . | |
| 5,306,222 | 4/1994 | Wilkinson . | |
| 5,397,288 | 3/1995 | Sayre . | |
| 5,403,269 | 4/1995 | Kennedy | 482/128 |
| 5,437,591 | 8/1995 | Chen . | |
| 5,507,712 | 4/1996 | Chang . | |

*Primary Examiner*—Lynne A. Reichard
*Attorney, Agent, or Firm*—Lott & Friedland, P.A.

[57] ABSTRACT

A spring-actuated, portable weight training device. The spring-actuated, portable weight training device includes a first compression assembly comprising a first compression spring, a second compression assembly comprising a second compression spring, an extension assembly for receiving the first and second compression assemblies, means for removably affixing the compression assemblies to the extension assembly, and means for compressing the first and second compression assemblies over the extension assembly, which compression assembly compression means preferably comprises either a pair of abdominal adapters or a pair of forearm securing elements or a pair of thigh adapters pivotably attached to the compression assemblies. The extension assembly comprises an adjustable strut having a plurality of openings along its length, a fixed strut having one opening along its length and capable of receiving the adjustable strut, and a pushbutton for removably securing the adjustable strut to the fixed strut, in order to accommodate users of various sizes and strengths.

1 Claim, 15 Drawing Sheets

SPRING-ACTUATED, PORTABLE WEIGHT TRAINING DEVICE

TECHNICAL FIELD

This invention relates generally to exercise equipment and this invention specifically relates to a portable, spring-actuated weight training device for use in developing and maintaining certain muscle groups of the human body.

BACKGROUND OF THE INVENTION

In the exercise and weight training industries, traditional devices have been bulky, heavy, and usually affixed in a permanent location to prevent them from toppling over. More recently, given the trend of business people and others who attempt to exercise wherever their travels may take them, portable weight training devices have entered the scene.

Previous attempts have been made to provide portable weight training devices, such as are described in U.S. Pat. No. 5,507,712, to Chang (the '712 patent); U.S. Pat. No. 5,437,591, to Chen (the '591 patent); U.S. Pat. No. 5,397,288, to Sayre (the '288 patent); U.S. Pat. No. 5,306,222, to Wilkinson (the '222 patent); U.S. Pat. No. 5,267,929, to Chen (the '929 patent); U.S. Pat. No. 5,186,701, to Wilkinson (the '701 patent); U.S. Pat. No. 5,031,906, to Jang (the '906 patent); U.S. Pat. No. 4,815,731, to Suarez et al. (the '731 patent); U.S. Pat. No. 4,428,577, to Weingardt (the '577 patent); U.S. Pat. No. 4,376,533, to Kolbel (the '533 patent); U.S. Pat. No. 4,290,599, to Berger (the '599 patent); U.S. Pat. No. 4,273,328, to Ozbey et al. (the '328 patent); and U.S. Pat. No. 886,032, to Barrett (the '032 patent), all of which are incorporated herein by reference.

The '712 patent describes a multipurpose exercising apparatus comprised of a first actuating device, a second actuating device, a connecting device, a pair of first extension tubes, a pair of second extension tubes, two expansion springs, and two handles. The actuating devices have a cylindrical casing at one end and a circular coupling at an opposite end and a connecting device to rotatably connect the circular couplings of the actuating devices together. The two first extension tubes are slidably fastened to the cylindrical casings of the actuating devices and the two second extension tubes are slidably fastened to the first extension tubes. The two handles are respectively coupled to the second extension tubes, with the two expansion springs respectively connected between the circular couplings of the actuating devices and the handles, and locks respectively mounted on the actuating devices for locking the first and second extension tubes inside the cylindrical casings of the actuating devices.

The '591 patent describes a chest expander and comprises a first handle having two distal ends, a substantially U-shaped tubular housing including a first line and a second line extended from two limb ends thereof and connected to two distal ends of the first handle. A second handle connected between the two limbs of the U-shaped tubular housing allows a user to hold thereon. A corner of the U-shaped tubular housing is formed as circular shape disposed with a load adjusting mechanism. The two handles of the chest expander are manually extended and retracted repeatedly via two lines.

The '288 patent describes a lightweight, compact, portable exercise device with a resistance adjust handle and a resistance meter handle attached to the resistance band assembly by the pressure exerted by the clamping action of a two-part molded grip handle and a two-pan molded grip shell on the resistance band assembly's outer jacket, as well as by the tension of the resistance band assembly's internally located resistance band. Attached to one end of the resistance band assembly is a resistance adjust handle, comprising a molded grip shell, a one-step resistance adjust knob and twin integrated foldable hand grips. The integration of molded grip shells, hand grips, and foot rests make the unit capable of a range of exercises. The one-step resistance adjust knob and resistance meter assembly make resistance adjustments.

The '906 patent describes an exercising machine, comprising two symmetric handles each having mounting holes at one side for mounting a compression link or three elastic cords, and two pairs of T-shaped blocks releasably connected to the two-symmetric handles at two opposite ends thereof. Two stands are formed for push-up exercise by combining the two pairs of T-shaped blocks with the two symmetric handles. By attaching the compression link to the two handles, one can utilize the device to exercise the muscles of the upper and lower extremities and the abdomen. If the elastic cords are attached to the two handles, a chest expander is formed for developing the muscles of the chest.

The '712 patent describes an exercise device for developing various parts of a user's and includes a pair of cuffs, an intervening coil spring and an elastic cord. A coil tension spring is attached and extends between a pair of cuff strips. The cuff strips are secured by hook and loop fastening strips such as Velcro® for receiving the wrists and ankles of the user. An elastic cord is attached to metal rings and extends within the coil spring for limiting the separation distance of the cuff strips and to provide increased resistance as the spring is stretched. The spring and cord are secured on the cuff strips with metal rings which extend through loops formed on each of the cuff strips by a reinforcing strip of material sewed on the cuff.

The '533 patent describes a push and pull physical exerciser comprising a telescopic system with an inner tube slidable within an outer tube and handles at the outer ends of the tubes. Resilient biasing means in the form of a compression spring, is located within the telescopic system so that it resists contraction of the system. A pair of flexible, substantially non extendible, tension elements extend, each in a single run, between the ends of the system and each end of each tension element passes round a guide member in the form of a pulley mounted in the associated handle and has its end connected to a stop member which prevents the end of the element from moving inwards towards the center of the system round the pulley. In the rest condition of the exerciser the tension elements will normally be just taut but may be initially under some tension caused by initial compression of the spring in the rest position. The tension elements may be of rope, wire, plastics, or any other suitable material and may be of belt form.

The '599 patent describes an exercising device which relies on a pneumatic resistance element, and wherein alternate strokes of air are inducted or expelled. Inner and outer telescoping cylindrical tubes, are provided with handles on their outer ends for manipulating the device, by exerting force in tension, to rectilinearly expand the length of the device, and in compression, to rectilinearly contract the length of the device. A flexible resilient washer mounted at the inner end of the inner tube slidably and sealingly engages the inner surface of the outer tube. Oppositely acting check valves are provided together with respective throttling means at the outer end of the outer tube adjacent its handle. The throttling means, depicted as a rotatable apertured outer sleeve, selectively connected to a check valve to the outer atmosphere, with one check valve permitting only ingress of air into the outer tube and the other check valve only permitting air egress.

The '328 patent describes a chest muscle and posture developer as indicated generally as and includes circular arm bands and which are secured to first and second back sections. The arm bands may be permanently affixed to the back sections by conventional means, such as stitching, or alternatively, the arm bands may be removably secured to the back sections by conventional fasteners such as snaps, hooks or zippers. The arm bands are preferably constructed primarily of strips of elasticized material having an open web or net-like structure to provide high porosity. This porosity of the arm bands improves comfort by facilitating the natural cooling of a user. The strips forming the arm bands are reinforced along the outermost edges thereof by solid bands of elasticized material. The material forming the circular arm bands is designed to stretch along an axis parallel to the reinforcing strips and includes an elongated, partially elasticized strip of fabric having at least one arm band attached to each end thereof. The elastic strip stretches length wise across a user's back and exerts a force which draws the arms and shoulders rearwardly.

None of the devices described above describe a means by which to secure a user's forearms within the device, which securing is an important element of many of the exercises which can be completed using a portable weight training device, and which securing means should also enable the user to enjoy pivotably rotate the device in order to accomplish a variety of exercises while maintaining his/her forearms in a secured position. Furthermore, none of the previous portable weight training devices provide a means for accommodating users of varying strengths and/or sizes, by providing, for example a means for varying the compression of the spring which provides the resistance in connection with the weight training exercises.

Thus, there is a need in the art for a spring-actuated, portable weight training device which provides a means for rigidly securing its user's forearms therein.

There is an additional need in the art for such a device, while rigidly securing its user's forearms therein, to enable its user to pivotably rotate the device in order to accomplish a variety of weight training exercises in a variety of positions.

There is an additional need in the art for such a device to accommodate users of varying strengths and sizes.

SUMMARY OF THE INVENTION

The present invention solves significant problems in the art by providing a spring-actuated, portable weight training device. Generally described, the present invention provides a spring-actuated, portable weight training device which includes a first compression assembly comprising a first compression spring; a second compression assembly comprising a -second compression spring; an extension assembly for receiving the first and second compression assemblies, the extension assembly comprising an adjustable strut having a plurality of openings along its length; a fixed strut having one opening along its length and capable of receiving the adjustable strut; and a pushbutton for removably securing the adjustable strut to the fixed strut; means for removably affixing the compression assemblies to the extension assembly; and means for compressing the first and second compression assemblies over the extension assembly.

In a preferred embodiment of the present invention, the compression assembly compressing means comprises a first forearm securing element removably affixed to the first compression assembly; a second forearm securing element removably affixed to the second compression assembly; and means for pivotably rotating the forearm securing elements about the compression assemblies.

In an alternative embodiment of the present invention, the compression assembly compressing means comprises a first abdominal adapter removably affixed to the first compression assembly; and a second abdominal adapter removably affixed to the second compression assembly.

In an alternative embodiment of the present invention, the compression assembly compressing means comprises a first thigh adapter removably affixed to the first compression assembly; and a second thigh adapter removably affixed to the adjustable strut of the expansion assembly.

Accordingly, it is an object of the present invention to provide a spring-actuated, portable weight training device which provides a means for rigidly securing its user's forearms therein.

It is an additional object of the present invention to provide a spring-actuated, portable weight training device which, while rigidly securing its user's forearms therein, enables its user to pivotably rotate the device in order to accomplish a variety of weight training exercises in a variety of positions.

It is an additional object of the present invention to provide a spring-actuated, portable weight training device which accommodates users of varying strengths and sizes.

These and other objects, features, and advantages of the present invention may be better understood and appreciated from the following detailed description of the embodiments thereof, selected for purposes of illustration and shown in the accompanying drawings.

DETAILED DESCRIPTION OF THE PREFERRED EMBODIMENT

Figure 1:
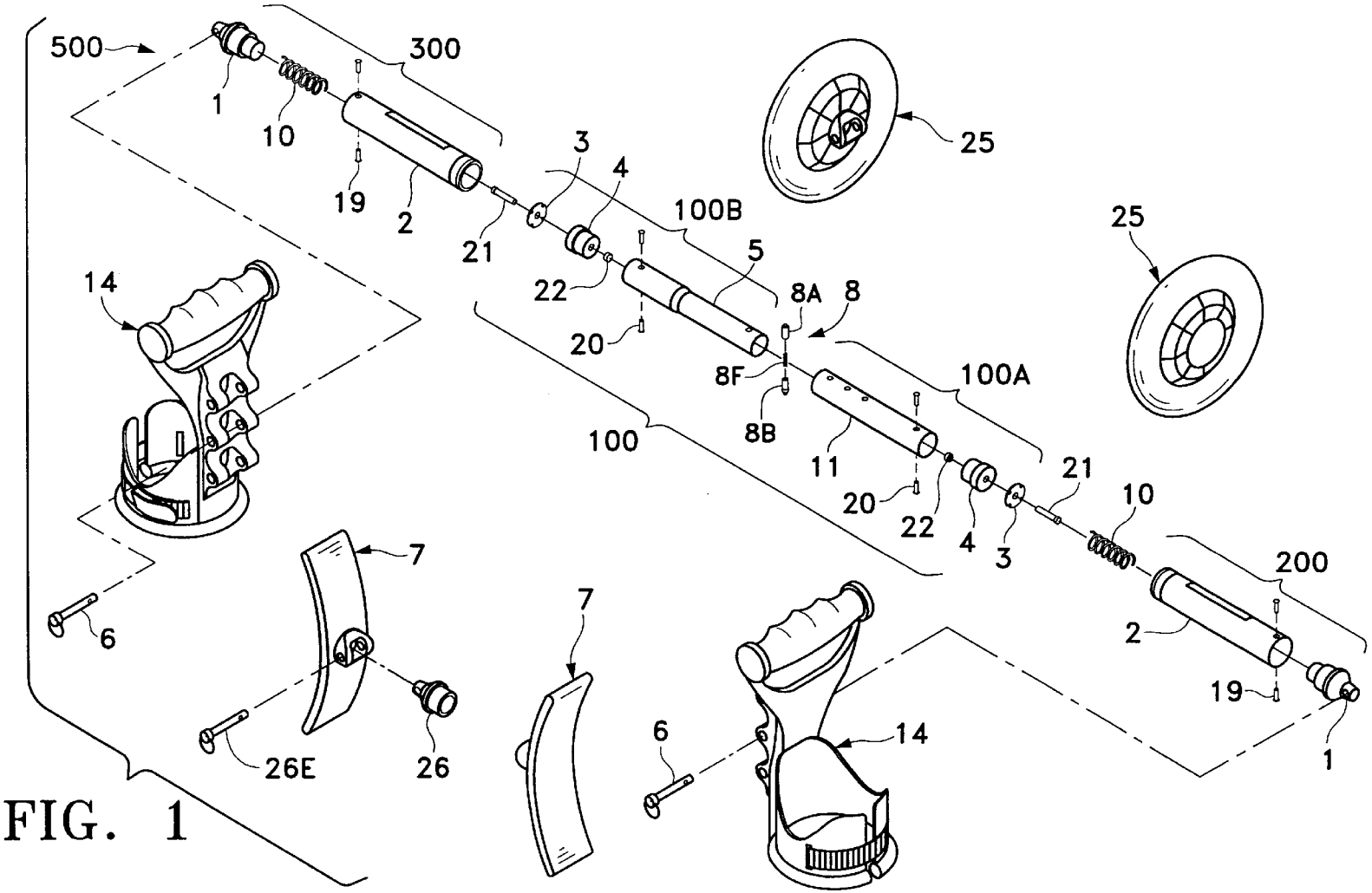
FIG. 1 is an exploded view of the portable weight training device with the forearm supporting element 14, abdominal adapters 25, and thigh adapter 7 accessories according to the present invention.

Referring initially to FIG. 1 of the drawings, in which like numerals indicate like elements throughout the several views, in a preferred embodiment the spring-actuated, portable weight training device of this invention is generally illustrated by reference numeral 500. Referring to the exploded view drawing depicted in FIG. 1, a portable weight training device 500 in accordance with the present invention generally comprises an extension assembly 100, a first compression assembly 200, a second compression assembly 300, and accessory attachments, including two forearm securing elements 14, two abdominal adapters 13, and two thigh adapters 7.

Figure 2:
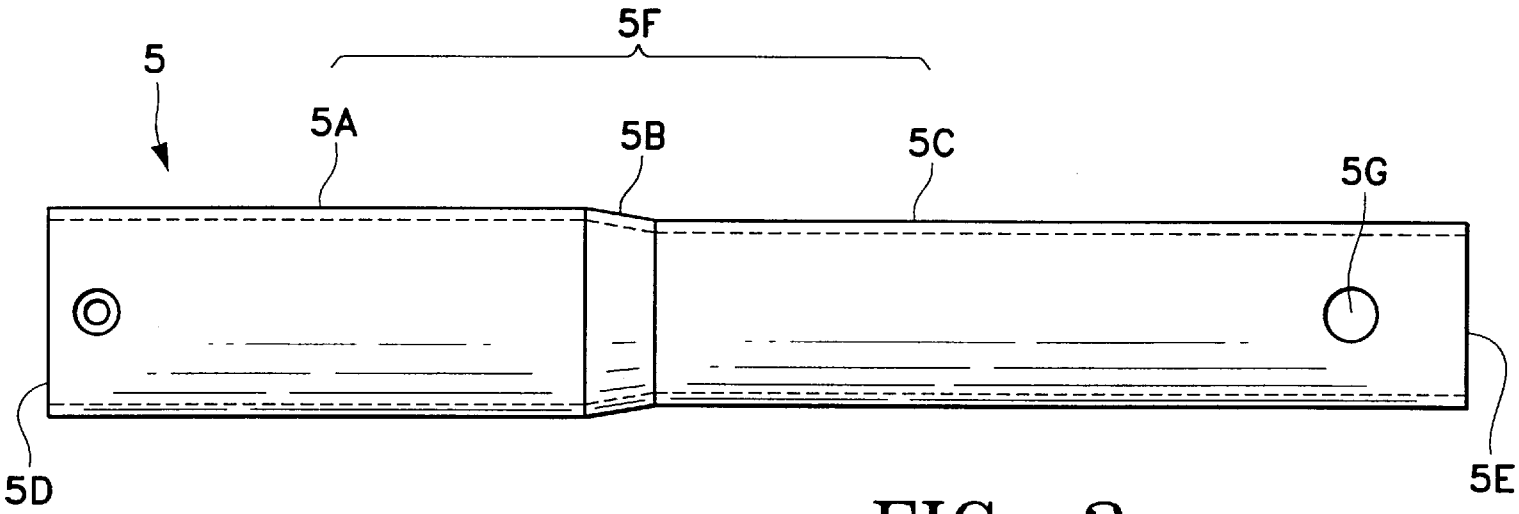
FIG. 2 shows a top plan view of the fixed strut 5 illustrating the outer diameter surface 5F.

The extension assembly 100 generally comprises a fixed strut 5, an adjustable strut 11, a spring button 8, and two strut plugs 4. The fixed strut 5, as shown in more detail in FIG. 2, includes a tube having a proximal end 5D and a distal end 5E with an outer diameter surface 5F, and a through hole 5G spaced from the distal end 5E. The outer diameter surface 5F comprises a first surface 5A, a middle surface 5B and a third surface 5C. The first surface 5A extends longitudinally from the proximal end 5D to meet the middle surface 5B that slopes diagonally inward to meet the third surface 5C that extends longitudinally to the distal end 5E, parallel to the first surface 5A, creating a greater tube wall thickness at the proximal end 5D than at the distal end SE.

Figure 3:
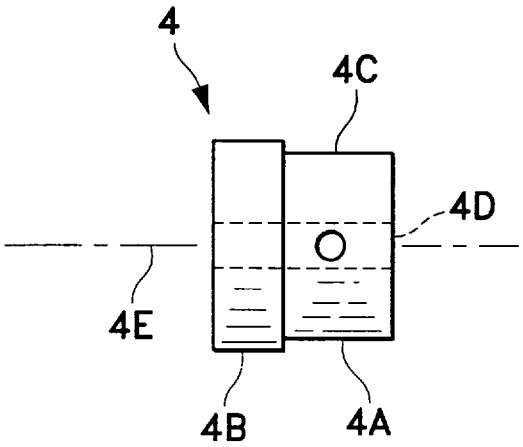
FIG. 3 shows a side plan view of the strut plug 4.
Figure 4:
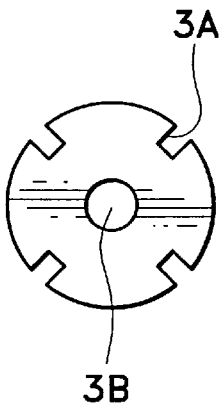
FIG. 4 shows a side plan view of the universal disk stop 3 illustrating notches 3A.

A strut plug 4 is fit into the proximal end 5D of the fixed strut 5. The strut plug 4, as shown in more detail in FIG. 3, comprises a lateral member 4A having a cylindrical surface 4C, a circular head 4B, and a through hole 4D along the center axis 4E through the lateral member 4A and the circular head 4B. The cylindrical surface 4C of the lateral member 4A is sized to fit into the proximal end 5D of the fixed strut 5. A universal stop disk 3, as shown in more detail in FIG. 4, is attached to the strut plug 4. The universal stop disk 3 includes a disk having a plurality of notches 3A spaced around the circumference of the disk and a center axis hole 3B through the center axis of the disc. The universal stop disk 3 is attached to the strut plug 4 by means of a threaded member 21, passing freely through the center axis holes 3B and 4D of the universal stop disk 3 and strut plug 4, respectively, and threaded into a tapped member 22. The strut plug 4 and fixed strut 5 are attached by threaded members 20, passing freely through the fixed strut 5 and threaded into tapped holes in lateral member 4A of the strut plug 4.

Figure 6:
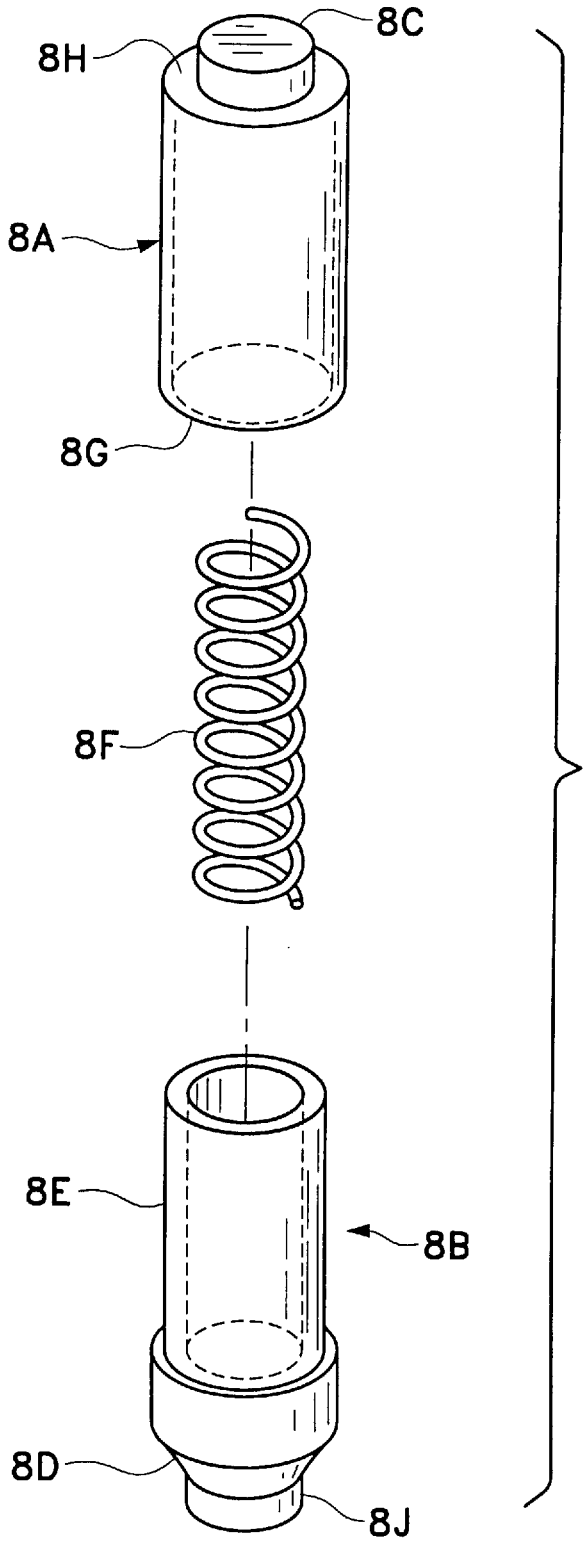
FIG. 6 shows an exploded view of the push button 8 which connects the fixed strut 5 with the adjustable strut 11.

A spring button 8, as shown in more detail in FIG. 6, is inserted into the distal side 5E of the fixed strut 5. Spring button 8 includes a male member 8B and a cylindrical female member 8A that house a compression spring 8F. The cylindrical female member 8A includes a receiving end 8G and an enclosed end 8H. A cylindrical finger 8C projects from the enclosed end 8H and is sized to fit into hole 5G in the fixed strut 5. The male member 8B includes a base head 8D and an upstanding cylindrical tube member 8E, sized to telescopically fit into the receiving end 8G of the cylindrical female member 8A. Base head 8D includes a downstanding cylindrical finger 8J sized to fit into hole 5G in the fixed strut 5, opposite the hole 5G in which the cylindrical finger 8C of the female member 8A fit into. Spring 8F, housed within cylindrical female member 8A and male member 8B, provides tension on cylindrical fingers 8C and 8J to remain in their respective hole 5G.

Figure 5:
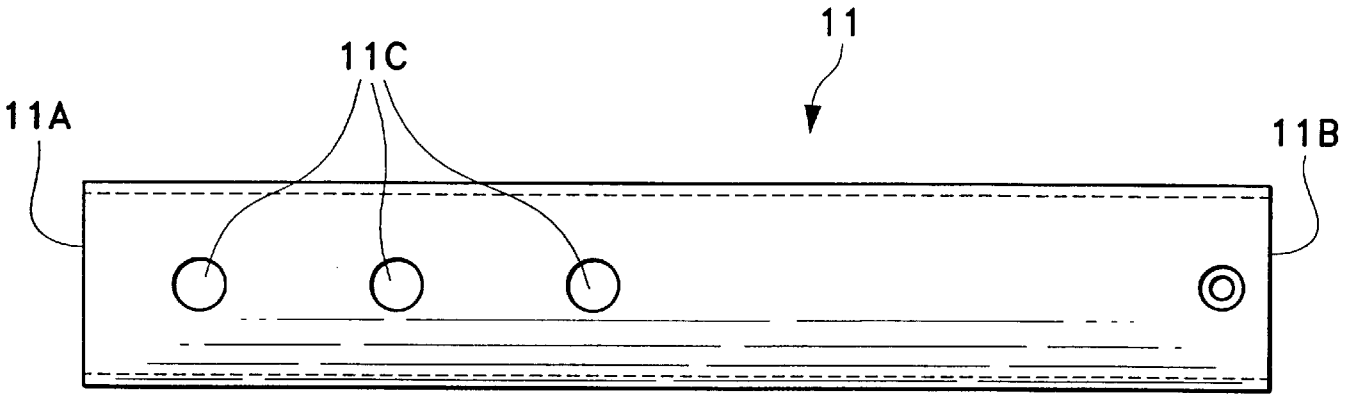
FIG. 5 shows a top plan view of the adjustable strut 11 illustrating the plurality of holes 11C.

The adjustable strut 11, as shown in more detail in FIG. 5, includes a tube, with a proximal end 11A and a distal end 11B, and a plurality of holes 11C evenly spaced longitudinally from the proximal end 11A. The third surface 5C of the fixed strut 5 is sized to be telescopically received by the proximal end 11A of the adjustable strut 11. This reception provides the extension of the portable weight training device 500 and is limited on the fixed strut 5 by the slopping middle surface 5B.

A strut plug 4, with accompanying universal stop disk 3, is sized to fit into and attach to the distal end 11B of the adjustable strut 11 in the same manner the strut plug 4, with accompanying universal stop disk 3, was sized to fit into and attach to the proximal end 5D of the fixed strut 5.

Figure 8:
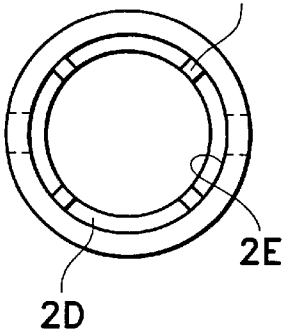
FIG. 8 shows the proximal end 2A view of spring housing 2 illustrating the ribs 2F and collar 2D on the inner diameter 2E.
Figure 7:
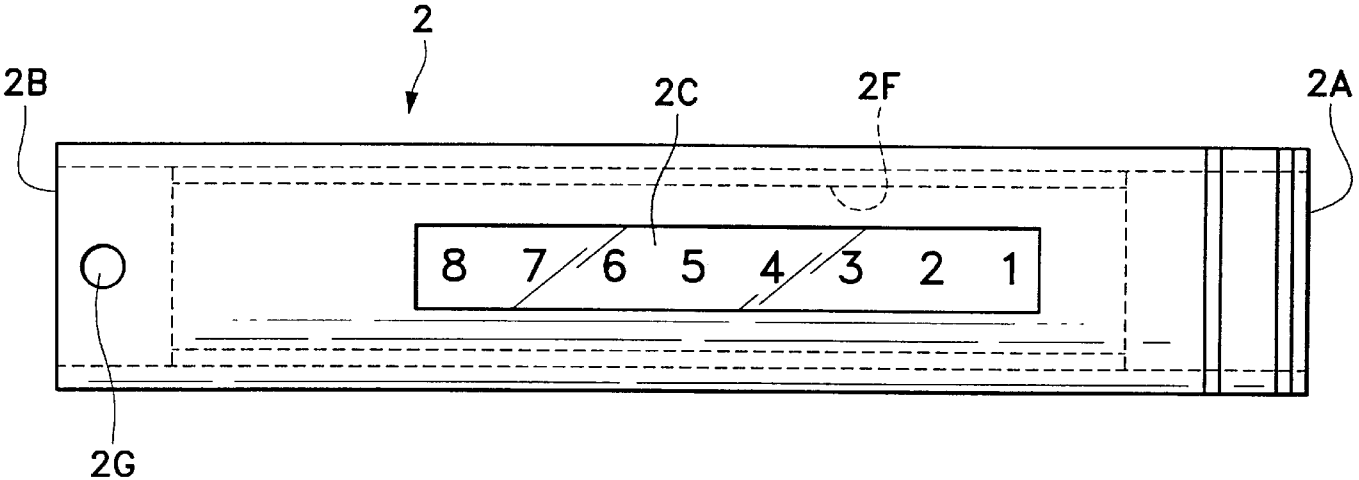
FIG. 7 shows a top plan view of the spring housing 2 illustrating the viewing slot 2C.

The first compression assembly 200 comprises a spring housing 2, a compression spring 10, and an end cap 1. The spring housing 2, as shown in more detail in FIG. 7 and FIG. 8, includes a tube, with a proximal end 2A and distal end 2B, a slot 2C machined longitudinally through the tube wall between the ends for viewing of the compression status during exercise, and collar 2D and a plurality of ribs 2F projecting from the inner diameter 2E of the spring housing 2. Collar 2D is located at the proximal end 2A of the spring housing and projects inward from the inner diameter 2E. The plurality of ribs 2F extend longitudinally along the inner diameter 2E of spring housing 2 and are spaced around the circumference to correspond to the notches 3A in the universal stop disk 3.

The portion 100A of the expansion assembly 100 extending from the proximal end 11A of the adjustable strut 11 to the universal stop disk 3, attached to the distal end 11B of the adjustable strut 11 as described above, is sized to telescopically fit into the spring housing 2 by aligning the ribs 2F on the inner diameter 2E of spring housing 2 with the notches 3A in the universal stop disk 3. The said portion 100A, leading with the proximal end 11A of the adjustable strut 11, is telescopically inserted into the distal end 2B of the spring housing 2 until the universal stop disk 3 is stopped by collar 2D on the inner diameter 2E of the proximal end 2A of the spring housing 2. Spring 10 is then inserted into the spring housing 2, confined within at the proximal end 2A by the stopped universal stop disk 3 and at the distal end 2B by an end cap 1.

Figure 9:
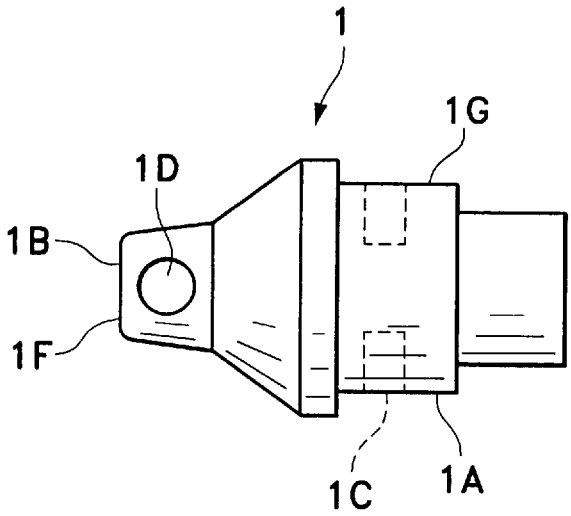
FIG. 9 shows a side plan view of end plug 1.
Figure 10:
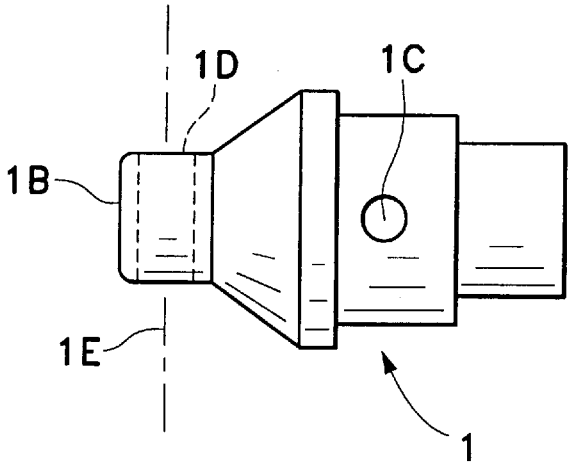
FIG. 10 shows a top plan view of end plug 1 illustrating protrusion member 1B.

End cap 1, as shown in more detail in FIG. 9 and FIG. 10, comprises a lateral member 1A, having a cylindrical surface 1G, and a mounting interface end 1F, with a mounting protrusion 1B projecting from the mounting interface end 1F. The cylindrical surface 1G of the lateral member 1A is sized to fit within the inner diameter 2E of the distal end 2B of the spring housing 2. The spring housing 2 and end cap 1 are attached together by threaded members 19 passing freely through hole 2G in spring housing 2 and freely into tapped holes 1C in the lateral member 1A of end cap 1. Alternative methods of attaching the end caps 1 to the spring housing 2, such as, for example, a locking mechanism or screw on/off mechanism may also be used. The mounting interface end 1F is identified as the interface to which a plurality of accessories are attached, such as the forearm securing elements 14, the abdominal adapter 13, or the thigh adapter 7. The mounting protrusion 1B includes through holes 1D, with center axis 1E, at one side.

Referring to FIG. 1 again, the second compression assembly 300 is symmetrical to the first compression assembly 200 but disposed in the opposite direction. The portion 100B of the expansion assembly 100 extending from the distal end 5E of the fixed strut 5 to the universal stop disk 3, attached to the proximal end 5D of the fixed strut 5 as described above, is sized to telescopically fit into the second spring housing 2, leading with the distal end 5E of the fixed strut 5, in the same manner as the insertion of portion 100A was fit into the first spring housing 2.

The adjustable strut 11 and fixed strut 5 are removably secured together by spring button 8. The cylindrical finger 8C of the cylindrical female member 8A of spring button 8 extends upward to freely pass through one of the holes 11C in the adjustable strut 11. The adjustable strut 11 and fixed strut 5 are telescopically adjusted by pressing the cylindrical finger 8C of the cylindrical female member 8A, which compresses the spring 8F, below the inner diameter of the adjustable strut 11 and sliding the adjustable strut 11 telescopically in or out until the cylindrical finger 8C is received by or aligns with another hole 11C. This adjustment controls the overall length of the portable training device 500, to accommodate users of varying strength and sizes. Additionally, this adjustment allows a means for varying the compression of the spring which provides the resistance in connection with the weight training exercises.

Figure 14:
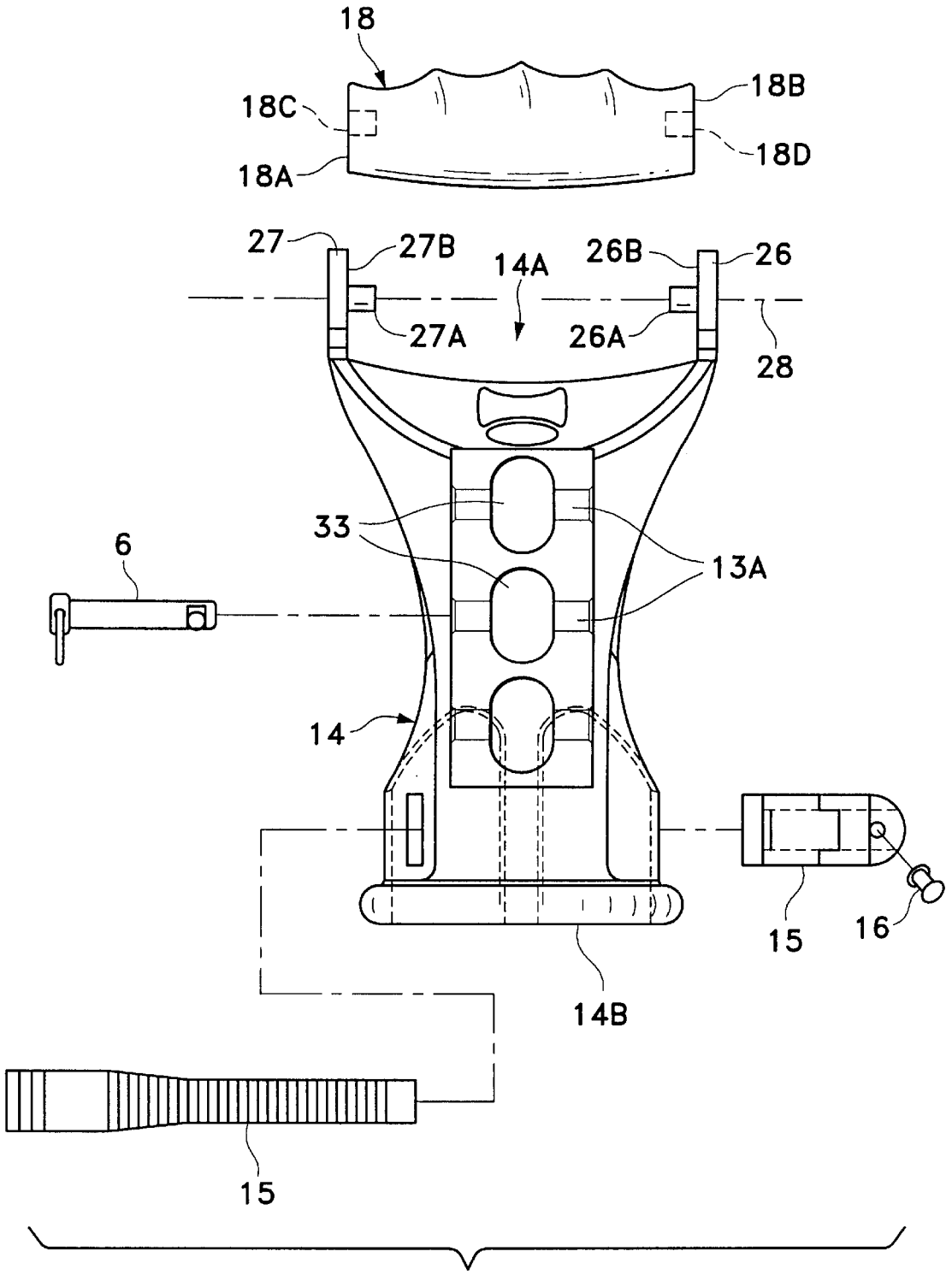
FIG. 14 is an exploded view of forearm supporting elements 14 according to the present invention.
Figure 15:
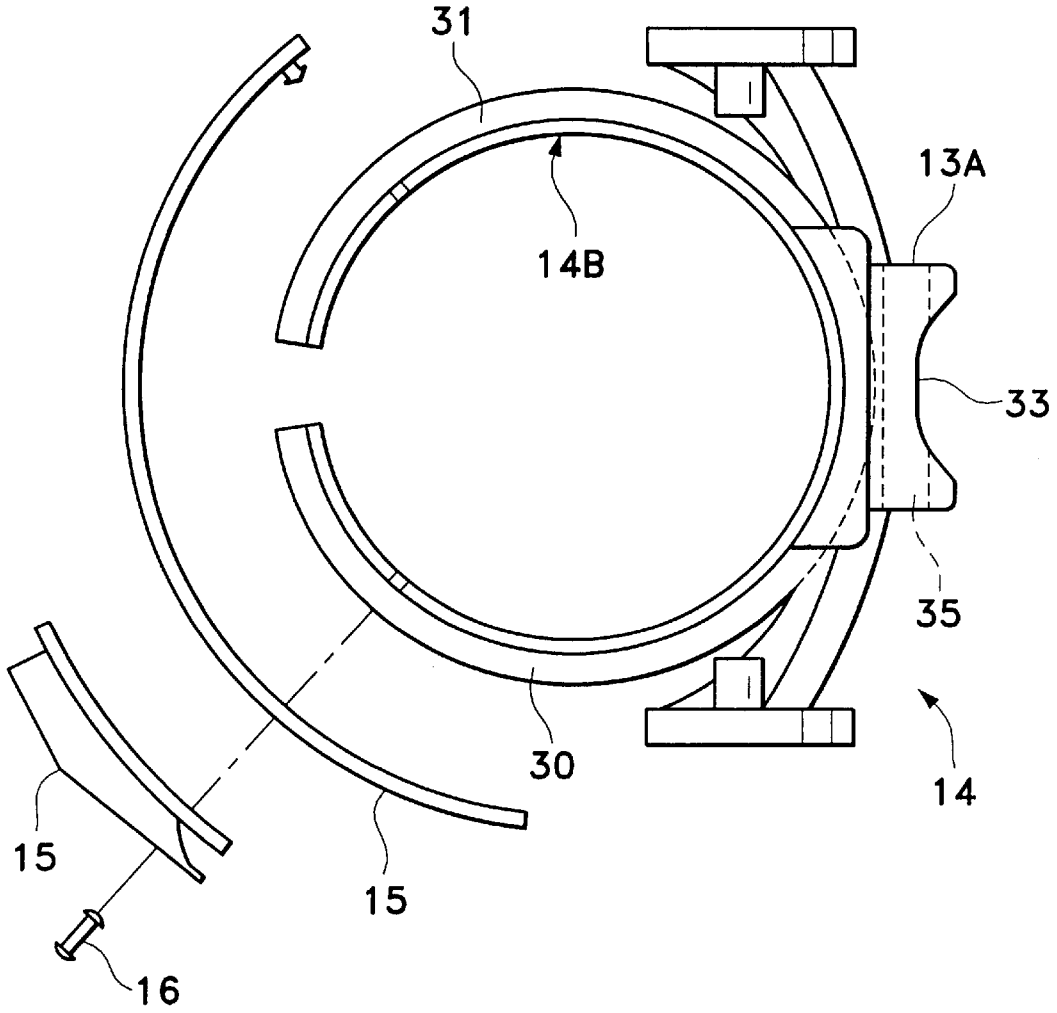
FIG. 15 shows the forearm closure end 14B plan view of the forearm supporting elements 14.
Figure 16:
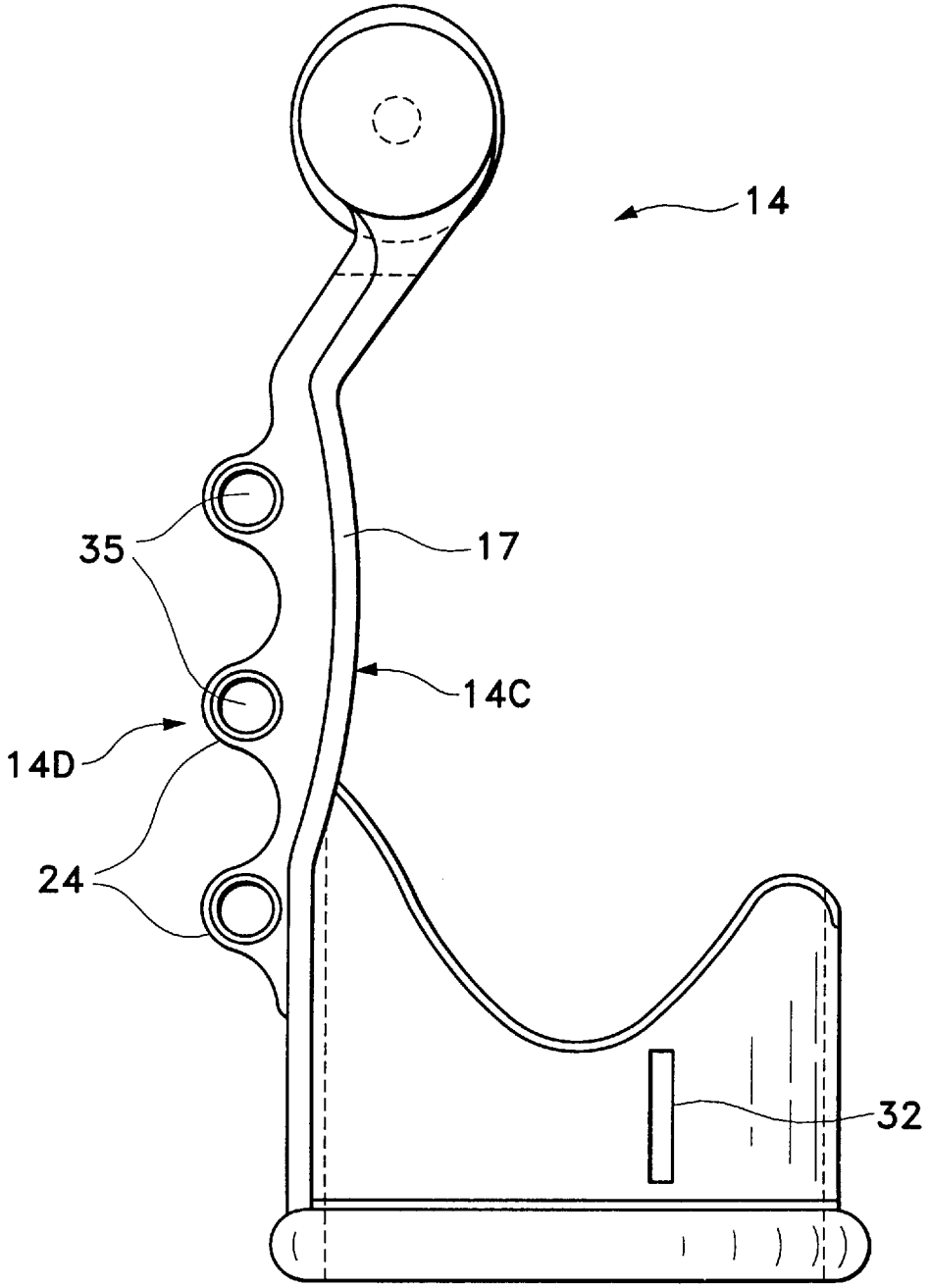
FIG. 16 shows a right side plan view of forearm supporting elements 14 illustrating holes 35 of accepters 24.
Figure 17:
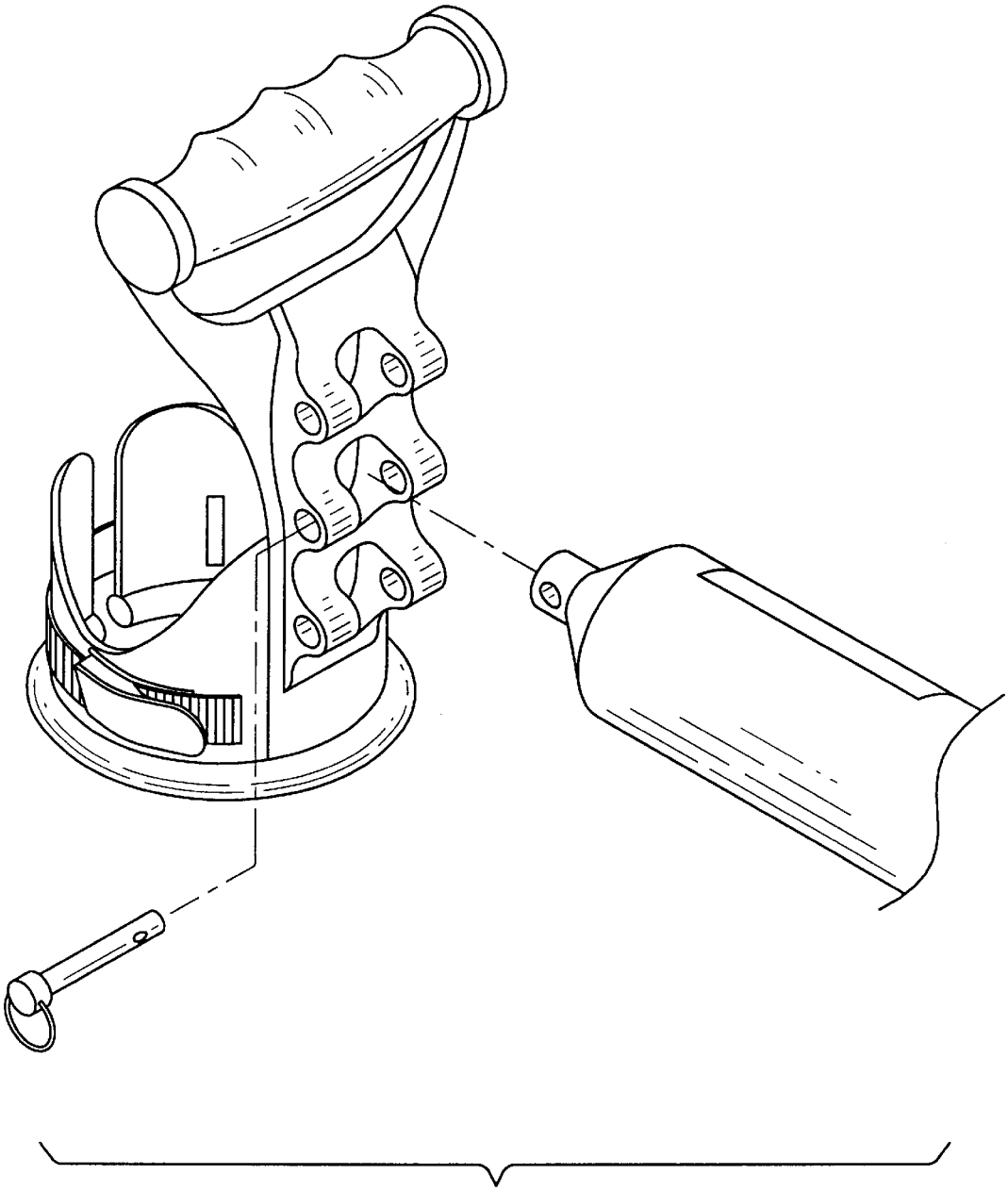
FIG. 17 shows the pivotal connection between the forearm supporting elements 14 and the end caps 1.
Figure 18:
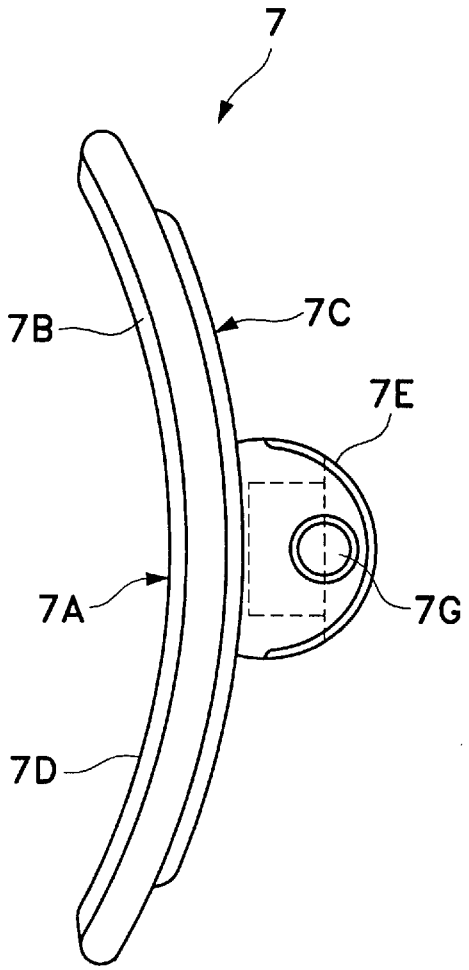
FIG. 18 shows a side plan view of thigh adapter 7 illustrating through hole 7 and concave surface 7D.

The forearm securing element 14, as shown in more detail in FIGS. 14, 15, and 16, comprises a U-shaped grip end 14A, a forearm closure end 14B, a flat forearm support side 14C, with foam insert 17, a mounting side 14D, handle 18, and adjustable strap 15. Referring first to FIG. 14, the U-shaped grip end 14A includes two limbs 26 and 27 formed as circular shapes disposed parallel with respect to one another, having circular inner surfaces 26B and 27B, respectively, defined as those surfaces facing each other and sharing the same central axis 28. Limbs 26 and 27 include symmetric fingers 26A and 27A, respectively, projecting from each inner surface 26B and 27B along the central axis 28. Handle 18 includes two distal ends 18A and 18B having each a cavity 18C and 18D, respectively, corresponding to the fingers 26A and 27A of limbs 26 and 27, respectively. As shown in FIG. 14 and 15, forearm closure 14B includes a first and second forearm support 30 and 31 to be coupled around the user's forearms, tightened together by an adjustable strap 15. Adjustable strap 15 is attached to the forearm closure 14B by means of a rivet 16, secured to the first forearm support member 30, and a slot 32 machined into the second forearm closure member 31. Mounting side 14D comprises a plurality of aligned accepters 24. Accepter 24 include a cavity 33, corresponding to mounting protrusion 1B on end cap 1, and through hole 35 at one side, shown in FIG. 16. The plurality of accepters 24 permit the forearm securing elements 14 to be positioned in accordance with the needs of the user. Forearm securing element 14 is pivotally connected to the compression assemblies 200 and 300 by means of accepter 13, mounting provision 1B and pull pin 6. When the mounting protrusion 1B of end cap 1 is inserted into cavity 33 of accepter 13A, the through hole 35 in the accepter 13A on the mounting side 14D of the forearm securing element 14 aligns with through hole 1D in mounting protrusion 1B of end cap 1. A pivotal connection is created by inserting pull pin 6 through the aligned holes 1D and 35. This connection permits the user to pivotably rotate the device 500 in order to accomplish a variety of weight training exercises in a variety of positions.

Figure 11:
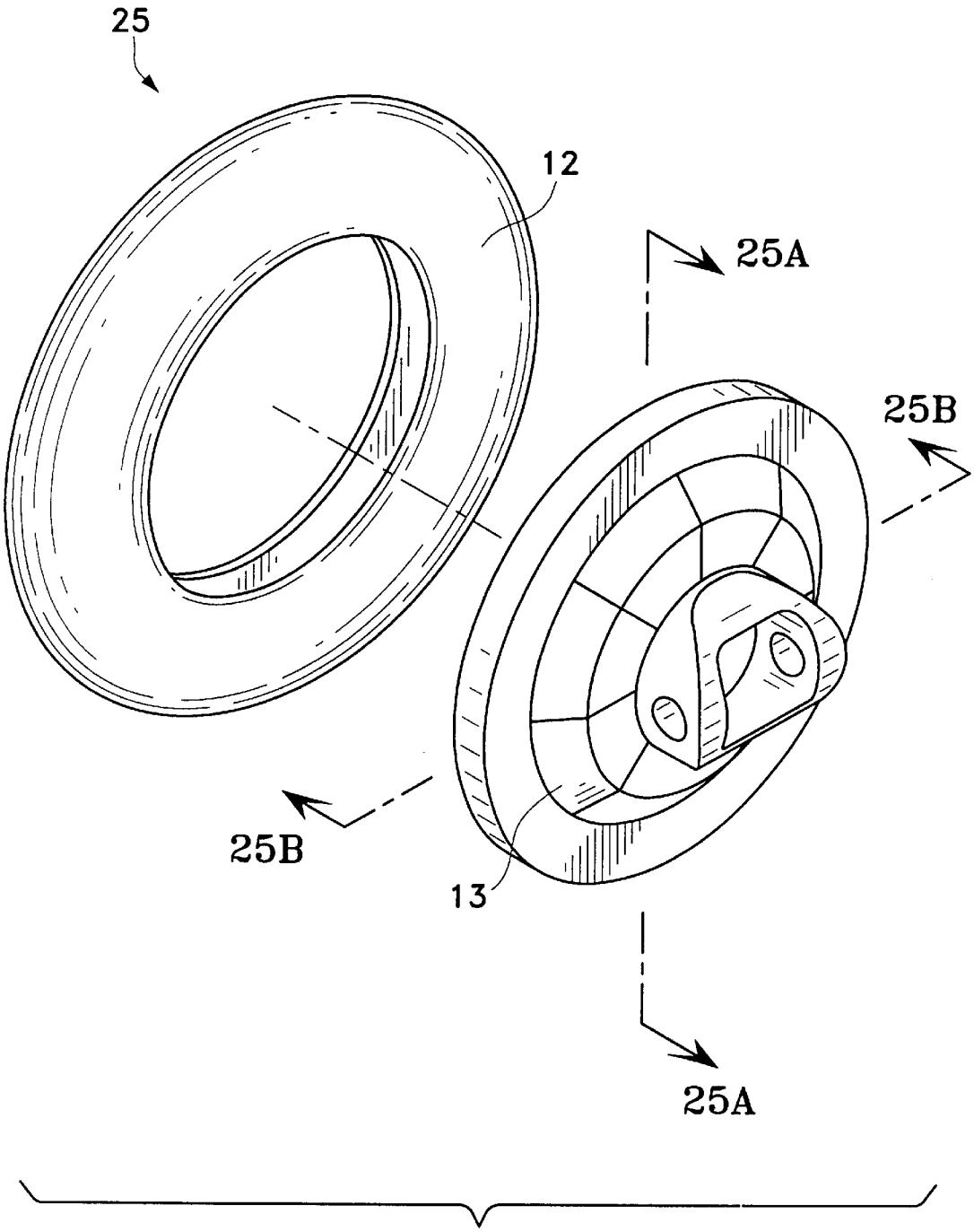
FIG. 11 is an exploded view of abdominal adapter 25 according to the present invention.
Figure 12:
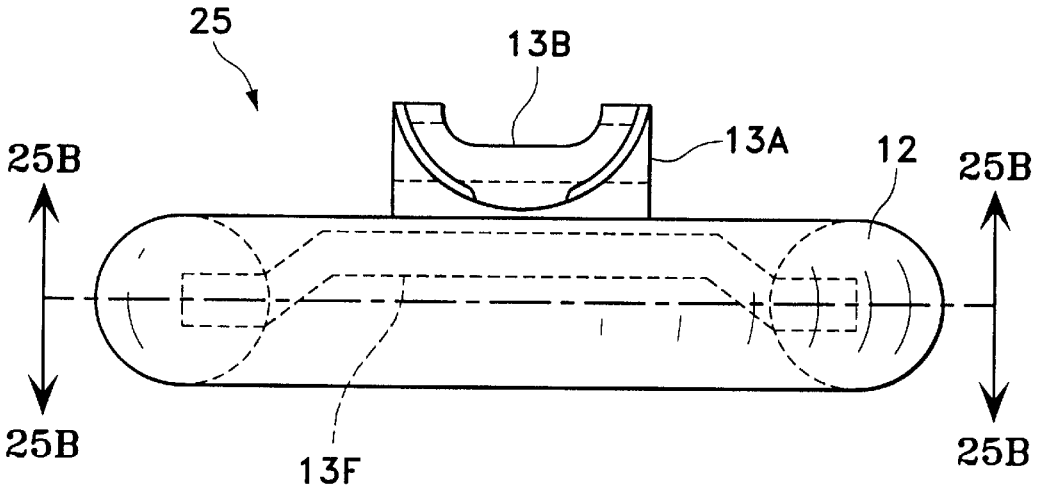
FIG. 12 is a sectional view taken along line 25A—25A of abdominal adapter 25 shown in FIG. 11.
Figure 13:
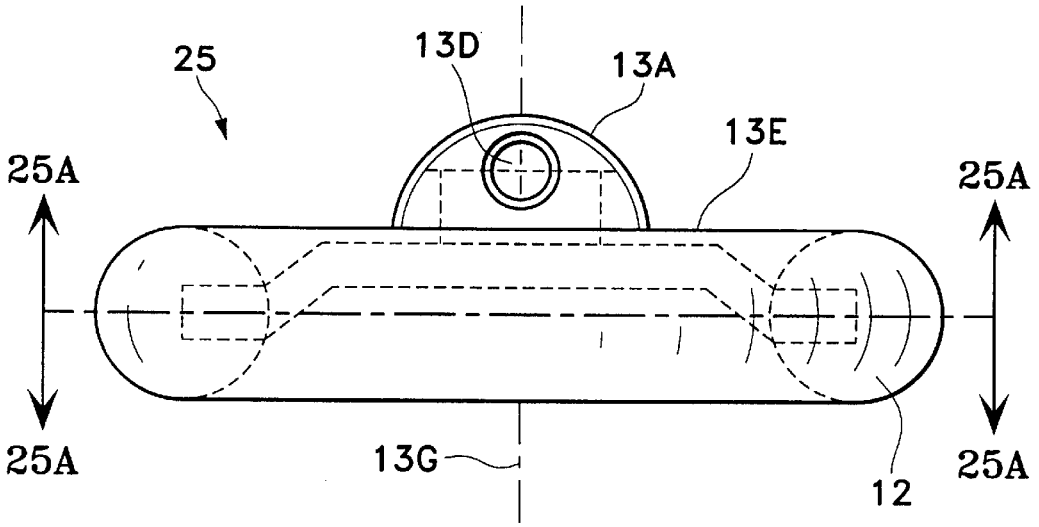
FIG. 13 is a sectional view taken along line 25B—25B of abdominal adapter 25 shown in FIG. 11.

In an alternative embodiment, the abdominal adapter 25 is interchanged with the forearm securing element 14. The abdominal adapter 25, as shown in more detail in FIGS. 11, 12, and 13, comprises a hub insert 13 and rubber tire 12. The hub insert 13 includes a conical disk with a mounting side 13E and a user interface side 13F. The mounting side 13E comprises an accepter 13A, projecting from the mounting side 13E along the central axis 13G of the hub insert 13. The accepter 13A is constructed similar to accepter 24 of the forearm securing element 14. Accepter 13A includes a cavity 13B, shown in more detail in FIG. 13, corresponding to the mounting protrusion 1B on end cap 1, and through hole 13D, shown in more detail in FIG. 12, at one side. When the mounting protrusion 1B of end cap 1 is inserted into cavity 13B, through hole 13D aligns with through hole 1D in mounting protrusion 1B. A pivotal attachment is created by inserting pull pin 6 through the aligned holes 1D and 13D.

Figure 19:
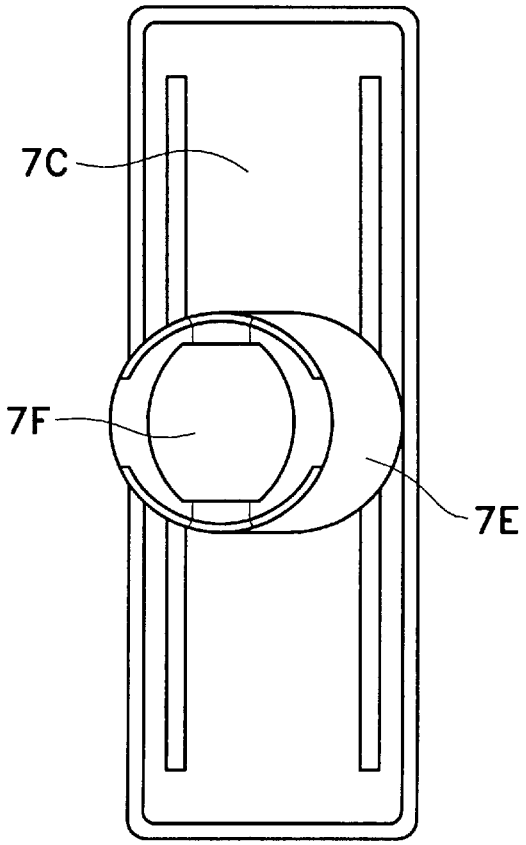
FIG. 19 shows the mounting side 7C plan view illustrating cavity 7F in accepter 7E.

In an alternative embodiment of the present invention, the thigh adapter 7 is interchanged with the forearm securing element 14 or the abdominal adapter 25. The thigh adapter 7, as shown in more detail in FIGS. 19 and 20, does not utilize compression assembly 300 or the portion 100B of expansion assembly 100. The use of only one compression assembly permits the device to fit between the user's thighs. A smaller version of the whole invention may be constructed with both compression assemblies to be fit between the user's thighs. The thigh adapters 7 attach to the proximal end 11A of the adjustable strut 11, by means of a thigh end cap 26, and to the end cap 1, attached to the distal side 2B of spring housing 2 of compression assembly 200. The thigh adapters 7 includes a user interface side 7A, a foam pad 7B, and a mounting side 7C. The user interface side 7A includes a concave surface 7D, to be fit around the contour of the user's thighs, with a foam pad 7B attached to provide comfort. The mounting side 7C comprises an accepter 7E, having a cavity 7F corresponding to the mounting protrusion 1B of end cap 1, projecting from the mounting side 7C .

Figure 20:
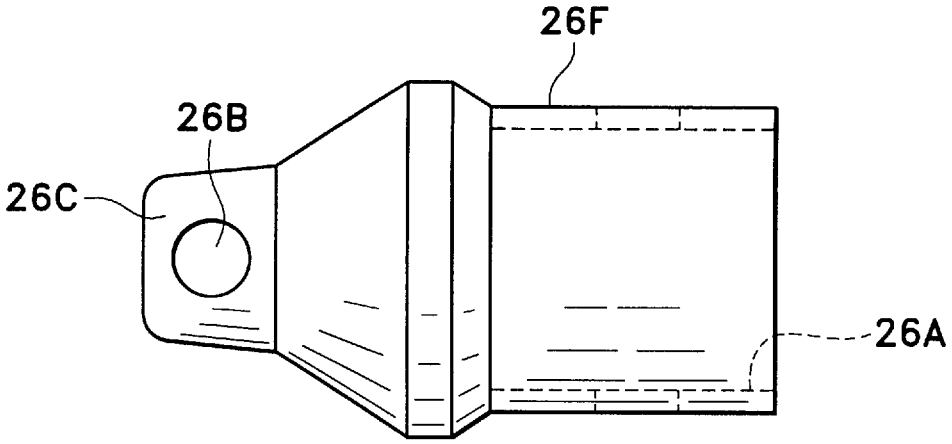
FIG. 20 shows a side plan view of the thigh end cap 26.
Figure 21:
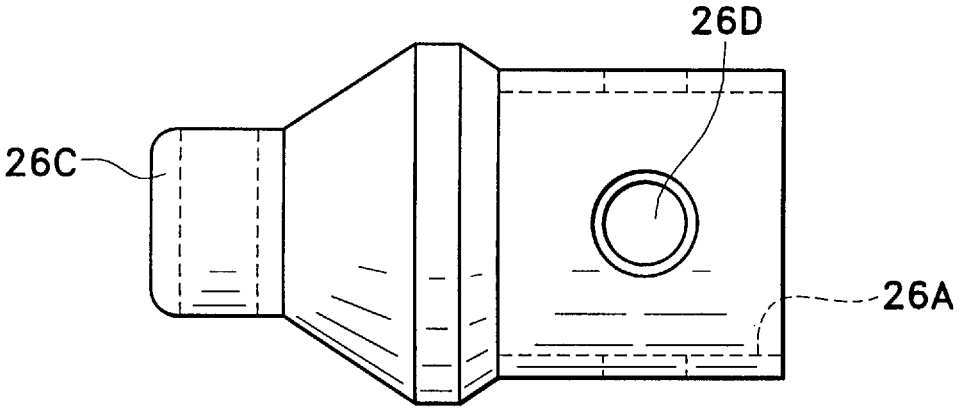
FIG. 21 shows a top plan view of the thigh end cap 26.

A thigh end cap 26, as shown in FIG. 1 and in more detail in FIGS. 20 and 21, is used to attach one of the thigh adapters 7 to the proximal side 11A of adjustable strut 11. The thigh end cap 26 includes a lateral tube member 26F, having an inner diameter 26A, and a lateral protrusion member 26C, having a through hole 26B at one side and disposed in the opposite direction of lateral tube member 26F. The inner diameter 26A of the lateral tube member 26F is sized to fit over the proximal end 11A of the adjustable strut 11. Pull pin 6 is used to attach the thigh end cap 26 with the adjustable strut 11 by passing through the first hole 11C in the adjustable strut 11 and though hole 26D in the lateral member 26F of thigh end cap 26. The use of a pull pin 6 at this location permits quick and easy interchangeability between the fixed strut 5 and thigh end cap 26. The protrusion member 26C is symmetric to the mounting protrusions 1B of end cap 1. The protrusion member 26C is fit into cavity 7F of accepter 7E of thigh adapter 7 and permanently attached to one thigh adapter 7 by rivet 26E passing through holes 26B and 7G.

The other thigh adapter 7 is attached to compression assembly 200 by the mounting protrusion 1B of end cap 1 attached to the distal end 2B of spring housing 2. When the mounting protrusion 1B of end cap 1 is inserted into cavity 7F, through hole 7G aligns with through hole 1D in mounting protrusion 1B. A pivotal attachment is created by inserting pull pin 6 through the aligned holes 1D and 7G .

OPERATION EXAMPLE I

Figure 22:
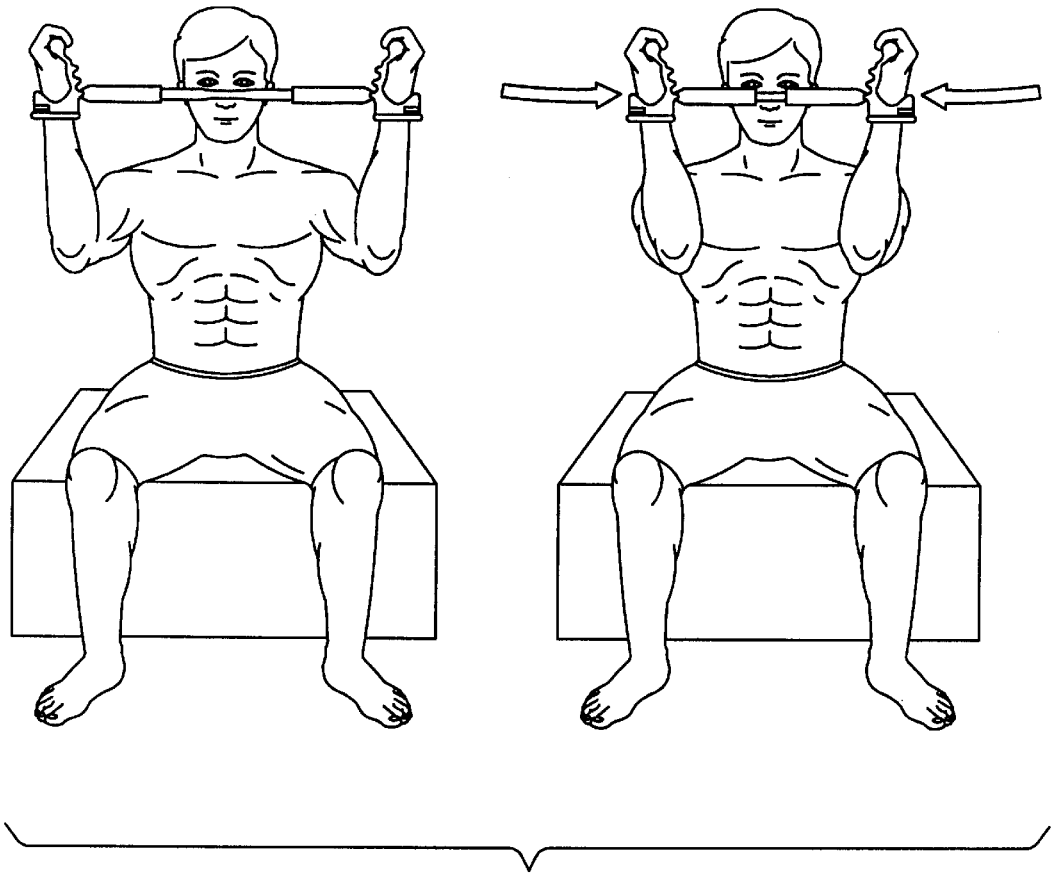
FIG. 22 shows an operational example of the present invention used with the forearm supporting elements 14 as a chest, biceps and back exerciser.

When the forearm securing elements 14 are pivotally attached to the end caps 1 located at the distal ends 2B of the spring housings 2 by pull pins 6, the portable weight training device 500 can be used to work the chest, back and biceps muscles. When the user's arms are correctly positioned in the forearm securing elements 14, the compression springs 10 provide resistance. Therefore, when the user pushes his forearms together, as shown in FIG. 22, the springs 10 compress while the spring housings 2 telescopically move inward, towards each other, over the distal side 11B of the adjustable strut 11 and the proximal side 5D of the fixed strut 5, respectively, meeting in the middle of the expansion assembly 100. The distance of compression for the springs is controlled by adjusting the attachment between the fixed strut 5 and the adjustable strut 11 by means of the spring button 8, as described above. The device is relaxed by allowing the spring housings 2 to separate, moving telescopically in the reverse direction over the adjustable strut 11 and the fixed strut 5, to the original position. The device can be held in a plurality of positions in order to isolate other muscles in the users' arms, back and chest.

OPERATION EXAMPLE II

The abdominial adapter 25 and forearm securing element 14 are interchangeable by releasing the pull pin 6 and attaching the abdominal adapter 25 to the end caps 1. With the abdominal adapter 25 pivotally attached to the end caps 1 by means of pull pin 6, the portable weight training device is alternatively used to exercise the user's abdominal muscles by placing one user interface side 13F of the abdominal adapter 25 in contact with the user's abdominal area and the other user interface side 13F against any fixed object.

OPERATION EXAMPLE III

The thigh adapter 7 is also interchangeable with the abdominal adapter 25 and forearm securing element 14. The abdominal adapter 25 or forearm securing element 14 are first disconnected from end cap 1 of compression assembly 200 by releasing the pull pin 6. The first thigh adapter 7 is then attached to said end cap 1. The second thigh adapter 7 is attached to the adjustable strut 11 by, first, disconnecting the fixed strut 5 and adjustable strut 11 by pressing spring button 8 and, then, attaching the thigh end cap 26, attached to the second thigh adapter 7, to the proximal end 11A of the adjustable strut 11. With the thigh adapters 7 pivotally attached to end caps 1 by means of pull pin 6 and attached to the proximal end 11A of adjustable strut 11 by means of pull pin 6, the portable weight training device is alternatively used to exercise the user's lower extremity muscles by placing the user interface sides 7A of thigh adapters 7 in contact with the user's inner thigh area.

Having described the invention in detail, those skilled in the art will appreciate that modifications may be made of the invention without departing from its spirit. Therefore, it is not intended that the scope of the invention be limited to the specific embodiments illustrated and described. Rather it is intended that the scope of the invention be determined by the appended claims and their equivalents.

What is claimed is:

1. A spring-actuated, portable weight training device, comprising:

a first compression assembly comprising a first compression spring;

a second compression assembly comprising a second compression spring;

an extension assembly for receiving said first and second compression assemblies, said extension assembly comprising:

an adjustable strut having a plurality of openings along its length;

a fixed strut having one opening along its length and capable of receiving said adjustable strut; and a pushbutton for removably securing said adjustable strut to said fixed strut;

means for removably affixing said compression assemblies to said extension assembly; and means for compressing said first and second compression assemblies over said extension assembly comprising:

a first forearm securing element removably affixed to said first compression assembly;

a second forearm securing element removably affixed to said second compression assembly; and means for pivotably rotating said forearm securing elements about said compression assemblies.

* * * * *